US010893785B2

(12) United States Patent
Crouch et al.

(10) Patent No.: US 10,893,785 B2
(45) Date of Patent: Jan. 19, 2021

(54) CLEANING APPLIANCE

(71) Applicant: Dyson Technology Limited, Wiltshire (GB)

(72) Inventors: Jeremy William Crouch, Swindon (GB); David Andrew Isley, Gloucester (GB)

(73) Assignee: Dyson Technology Limited, Wiltshire (GB)

( * ) Notice: Subject to any disclaimer, the term of this patent is extended or adjusted under 35 U.S.C. 154(b) by 198 days.

(21) Appl. No.: 16/232,432

(22) Filed: Dec. 26, 2018

(65) Prior Publication Data

US 2019/0200827 A1 Jul. 4, 2019

(30) Foreign Application Priority Data

Dec. 30, 2017 (GB) ..... 1722303.3

(51) Int. Cl.
*A47L 9/14* (2006.01)
*A47L 9/16* (2006.01)
(Continued)

(52) U.S. Cl.
CPC ..... *A47L 9/1463* (2013.01); *A47L 5/24* (2013.01); *A47L 9/102* (2013.01); *A47L 9/1691* (2013.01); *A47L 9/322* (2013.01)

(58) Field of Classification Search
None
See application file for complete search history.

(56) References Cited

U.S. PATENT DOCUMENTS 8,100,999 B2 * 1/2012 Ashbee ..... A47L 9/1641 55/343
8,640,301 B1 * 2/2014 Lee ..... A47L 9/1691 15/347
(Continued)

FOREIGN PATENT DOCUMENTS

CN 107080495 8/2017
GB 2408923 6/2005
(Continued)

OTHER PUBLICATIONS

International Search Report and Written Opinion dated Mar. 14, 2019, directed to International Application No. PCT/GB2018/053592; 11 pages.
(Continued)

*Primary Examiner* — Christopher P Jones
*Assistant Examiner* — Brit E. Anbacht
(74) *Attorney, Agent, or Firm* — Morrison & Foerster LLP

(57) ABSTRACT

A cleaning appliance includes a dirt separator for separating dirt from an airflow, and a main body, the dirt separator including a bin for collecting dirt separated from the airflow, and the main body including a runner portion extending alongside a side wall of the bin, wherein the bin is slidable along the runner portion between an operational position and an extended position, and a release catch releasably engages with a formation on the runner portion to prevent the bin from being separated from the cleaning appliance, and wherein the release catch is positioned on the side wall of the bin such that it is hidden by the runner portion of the main body unless the bin is in the extended position.

7 Claims, 4 Drawing Sheets

(51) Int. Cl.

| | |
|---|---|
| ***A47L 5/24*** | (2006.01) |
| ***A47L 9/10*** | (2006.01) |
| ***A47L 9/32*** | (2006.01) |

(56) References Cited

U.S. PATENT DOCUMENTS

| | | | | |
|---|---|---|---|---|
| 2014/0137363 | A1* | 5/2014 | Wilson | A47L 9/1683 15/347 |
| 2014/0237761 | A1 | 8/2014 | Holz | |
| 2015/0230679 | A1 | 8/2015 | Henderson | |
| 2017/0112341 | A1* | 4/2017 | Han | A47L 9/1608 |
| 2017/0215664 | A1* | 8/2017 | Conrad | A47L 1/05 |
| 2017/0303754 | A1* | 10/2017 | Conrad | A47L 5/28 |
| 2018/0000303 | A1* | 1/2018 | Conrad | A47L 9/1683 |
| 2018/0055320 | A1* | 3/2018 | Hwang | A47L 9/1666 |
| 2018/0125314 | A1* | 5/2018 | Kim | H01M 2/1066 |
| 2018/0213985 | A1* | 8/2018 | Song | A47L 9/1683 |
| 2019/0200825 | A1* | 7/2019 | Crouch | A47L 9/102 |
| 2019/0200827 | A1* | 7/2019 | Crouch | A47L 9/102 |
| 2019/0200830 | A1* | 7/2019 | Crouch | A47L 9/102 |
| 2019/0274503 | A1* | 9/2019 | Hyun | A47L 9/108 |
| 2020/0069128 | A1* | 3/2020 | Cho | A47L 9/1691 |
| 2020/0170467 | A1* | 6/2020 | Pougher | A47L 9/1683 |

FOREIGN PATENT DOCUMENTS

| | | |
|---|---|---|
| GB | 2546541 | 7/2017 |
| JP | 2003-339596 | 12/2003 |

OTHER PUBLICATIONS

Search Report dated Jun. 21, 2018, directed to GB Application No. 1722303.3; 1 page.

* cited by examiner

CLEANING APPLIANCE

REFERENCE TO RELATED APPLICATIONS

This application claims the priority of United Kingdom Application No. 1722303.3 filed Dec. 30, 2017, the entire contents of which are incorporated herein by reference.

FIELD OF THE INVENTION

The present invention relates to a cleaning appliance.

BACKGROUND OF THE INVENTION

Improvements to vacuum cleaners are always being sought. In particular improvements that make it easier for a user to use the vacuum cleaner, and to encourage the user the use the vacuum cleaner in the best way possible. It is desirable to ensure that the user is not able to carry out any operations which could result in a fault that needs to be resolved or requires troubleshooting.

SUMMARY OF THE INVENTION

A first aspect of the present invention provides a cleaning appliance comprising a dirt separator for separating dirt from an airflow, and a main body, the dirt separator comprising a bin for collecting dirt separated from the airflow, and the main body comprising a runner portion extending alongside a side wall of the bin, wherein the bin is slidable along the runner portion between an operational position and an extended position, and a release catch releasably engages with a formation on the runner portion to prevent the bin from being separated from the cleaning appliance, and wherein the release catch is positioned on the side wall of the bin such that it is hidden by the runner portion of the main body unless the bin is in the extended position.

As a result, the bin can only be removed from the cleaning appliance once the bin has been moved into the extended position from the operational position, reducing the likelihood of accidental removal of the bin during use. In addition, the bin can only be removed from the dirt separator once the bin has been emptied of dirt and dust when in the extended position. Furthermore, by hiding the release catch within the runner portion when the bin is in the operational position, the appearance of the cleaning appliance is cleaner and does not look cluttered, leading to a more aesthetically pleasing appliance.

The catch may be pivotably fixed to the side wall of the bin. This provides a very simple catch mechanism which is easy for a user to actuate, and which is cheap to manufacture.

The catch may be biased away from the side wall of the bin towards the formation on the runner. As a result, the catch will always engage with the formation on the runner portion whichever way the cleaning appliance is being held.

The bin may be removable from the cleaning appliance by first sliding the bin from the operational position to the extended position, then disengaging the catch from the formation and then continuing to slide the bin in the same direction.

The bin may comprise a bin lid hingedly attached to the side wall of the bin, and the bin lid is pivotably movable between a closed position in which dirt is retained in the bin and an open position in which dirt can escape the bin. This allows for easy emptying of dirt from the bin.

A bin lid catch may releasably hold the bin lid in the closed position, and the bin lid catch may be released upon the bin reaching the extended position from the operational position. As the release of the catch is in response to the bin reaching the extended position, a more hygienic dirt emptying procedure is achieved.

The cleaning appliance may be a handheld vacuum cleaner.

BRIEF DESCRIPTION OF THE DRAWINGS

In order that the present invention may be more readily understood, embodiments of the invention will now be described, by way of example, with reference to the following accompanying drawings, in which.

DETAILED DESCRIPTION OF THE INVENTION

Figure 1:
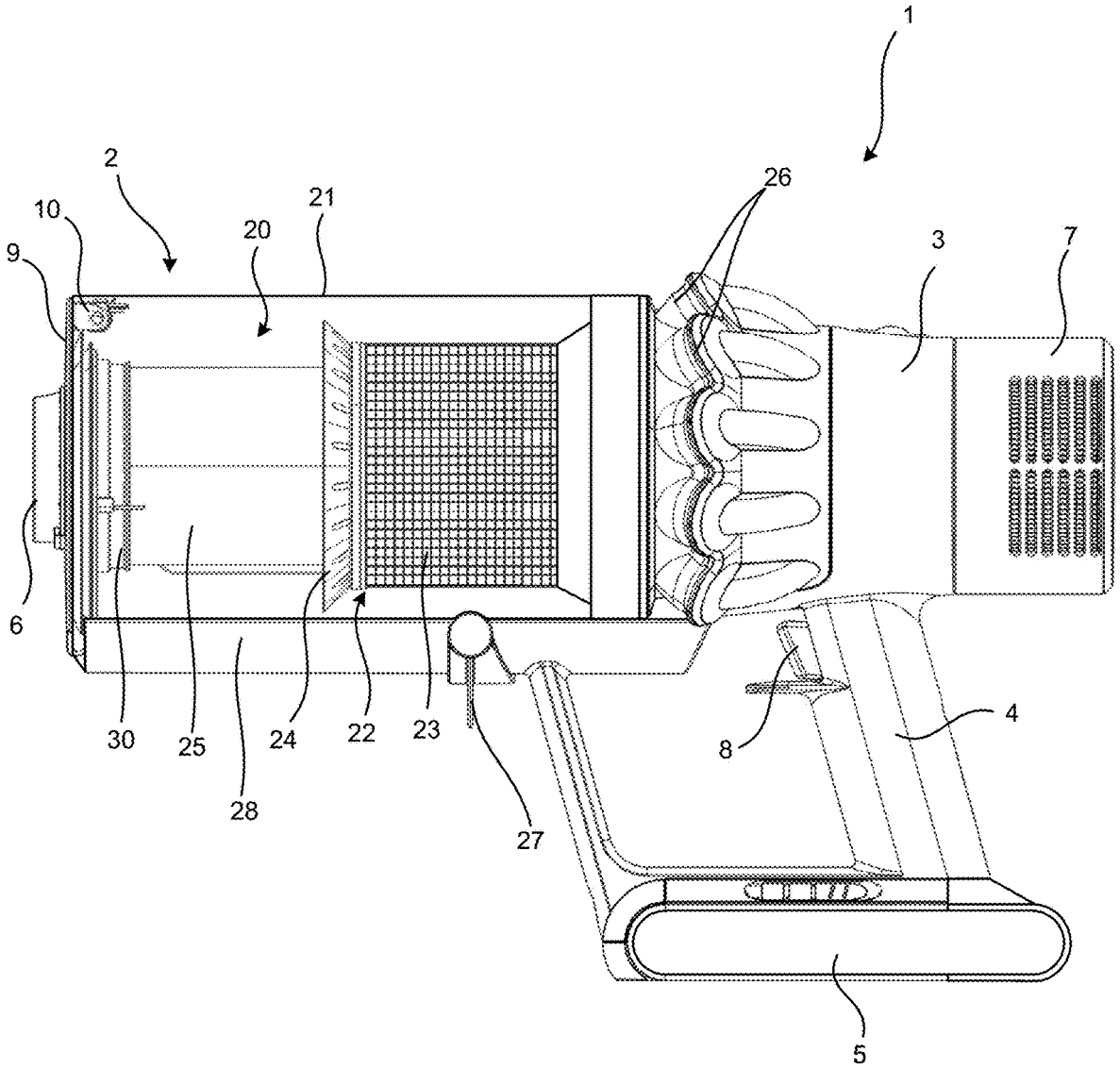
FIG. 1 shows a vacuum cleaner.

FIG. 1 shows a cleaning appliance in the form of a handheld vacuum cleaner 1 having a dirt separator 2, a main body 3, a handle 4, a power source in the form of battery pack 5, and an inlet 6. The main body 3 comprises a runner portion 28 which supports the dirt separator 2. At the rear of the vacuum cleaner 1, attached to the main body 3, is a filter assembly 7. The vacuum cleaner 1 is operated by the trigger 8 in the handle 4.

The dirt separator 2 has a first separation stage and a second separation stage. The first separation stage comprises a cylindrical outer wall 21 which defines a bin 20. In FIG. 1 the bin 20 is in an operational position. A cylindrical inner wall 25 defines a fine dust collection chamber which is positioned inside the bin 20. A closure member in the form of a bin lid 9 is hingedly attached to the outer wall 21 of the dirt separator 2 at hinge 10. The bin lid 9 is pivotable about the hinge 10 between an open position in which dust and dirt can escape from open ends of the bin 20 and fine dust collection chamber, and a closed position in which the bin lid 9 seals the open ends of both the bin 20 and fine dust collection chamber. The bin lid 9 comprises a seal 30 which seals against the inner wall 25. A central portion of the bin lid 9 comprises a hole or opening through which the suction inlet 6 protrudes.

Inside the bin 20 is a shroud 22 comprising a cylindrical screen 23 and a shroud skirt 24. During operation, air is drawn into the vacuum cleaner 1 through the inlet 6 by a fan motor housed within the main body 3. The dirt-laden air enters the bin 20 through a separator inlet (not shown) in the side wall of the shroud 22 which is joined to the inlet 6 by an inlet duct extending between the two, the inlet duct extending through the inside of the fine dust collection chamber. The air spirals around the inside of the bin 20, and centrifugal forces separate out larger dirt particles from the airflow which settle the in bin 20. The shroud screen 23 comprises a plurality of perforations through which air exits the first separation stage.

The second separation stage comprises a plurality of cyclone bodies 26. The air passes through the cyclone bodies 26 which separate any remaining dirt and dust from the airflow. The dirt and dust separated in the second separation stage collects in the fine dust collection chamber which is defined by the inner wall 25. Cleaned air exits the cyclones 26, passes through the fan motor in the main housing 3 and then is expelled from the vacuum cleaner 1 through the filter assembly 7.

Figure 2A:
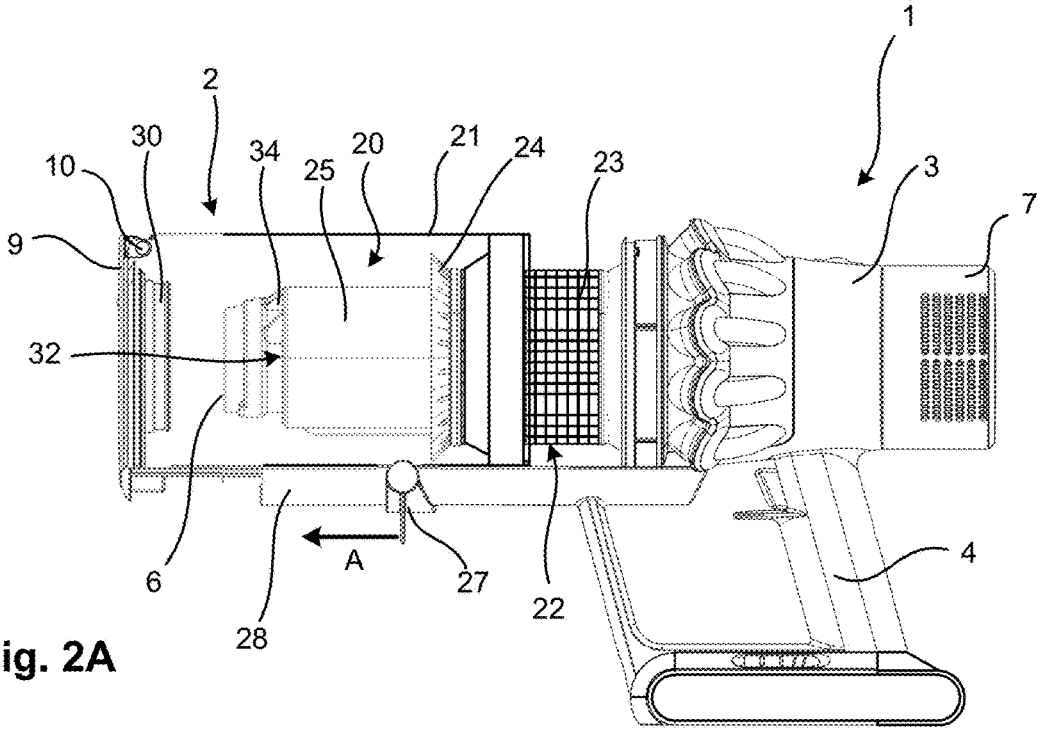
FIGS. 2A and 2B show the vacuum cleaner of FIG. 1 at different stages during a bin opening procedure.
Figure 2B:
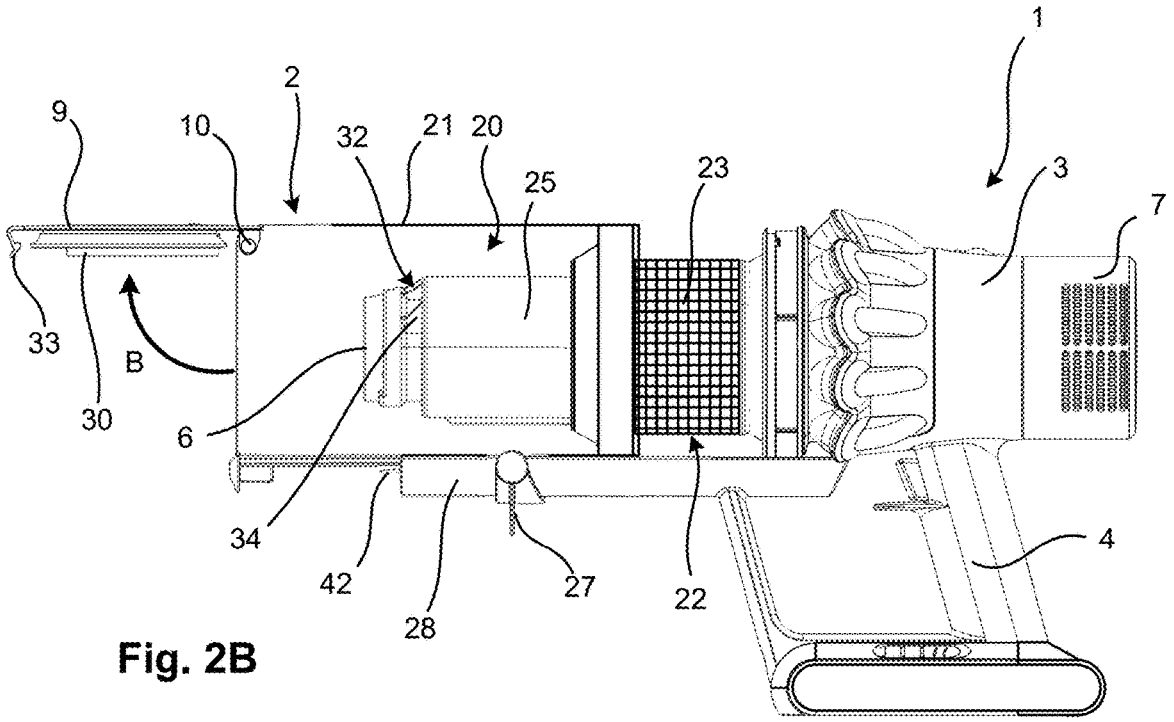

In order to empty the bin 20 and the fine dust collection chamber, the bin lid 9 can be opened. FIGS. 2A, and 2B show the vacuum cleaner 1 at different stages during a bin emptying procedure. The dirt separator 2 is provided with a bin opening actuator 27 which is fixed to the outer wall 21. When the bin opening actuator 27 is pushed in a direction away from the handle 4, as represented by arrow A in FIG. 2A, this causes the bin 20 (i.e. both the outer wall 21 and the bin lid 9) to slide along the runner portion 28 of the vacuum cleaner 1 in the same direction. The shroud 22, inner wall 25, and the inlet 6 remain stationary as they are fixed to the main body 3. The seal 30 is separated from the inner wall 25, revealing the open end of the second dirt collection chamber 32. Once the outer wall 21 has reached a certain point in the direction away from the handle, the bin 20 is in an extended position as shown in FIG. 2B. In the extended position, the outer wall 21 stops moving and a bin lid catch 33 holding the bin lid 9 closed is released. The bin lid 9 is hinged and a biasing member in the hinge 10 biases the bin lid 9 into an open position. Accordingly, as soon as the bin lid catch 33 is released, the bin lid 9 pivots around the hinge 10, and swings open as represented by arrow B. Dirt collected within the bin 20 and the fine dust collection chamber 32 can now be ejected from the dirt separator 2.

Closing the dirt separator 2 comprises sliding the outer wall 21 back to the original operational position and pivoting the bin lid 9 into a closed position until the bin lid catch 33 engages again to hold the bin lid 9 in the closed position.

Figure 3:
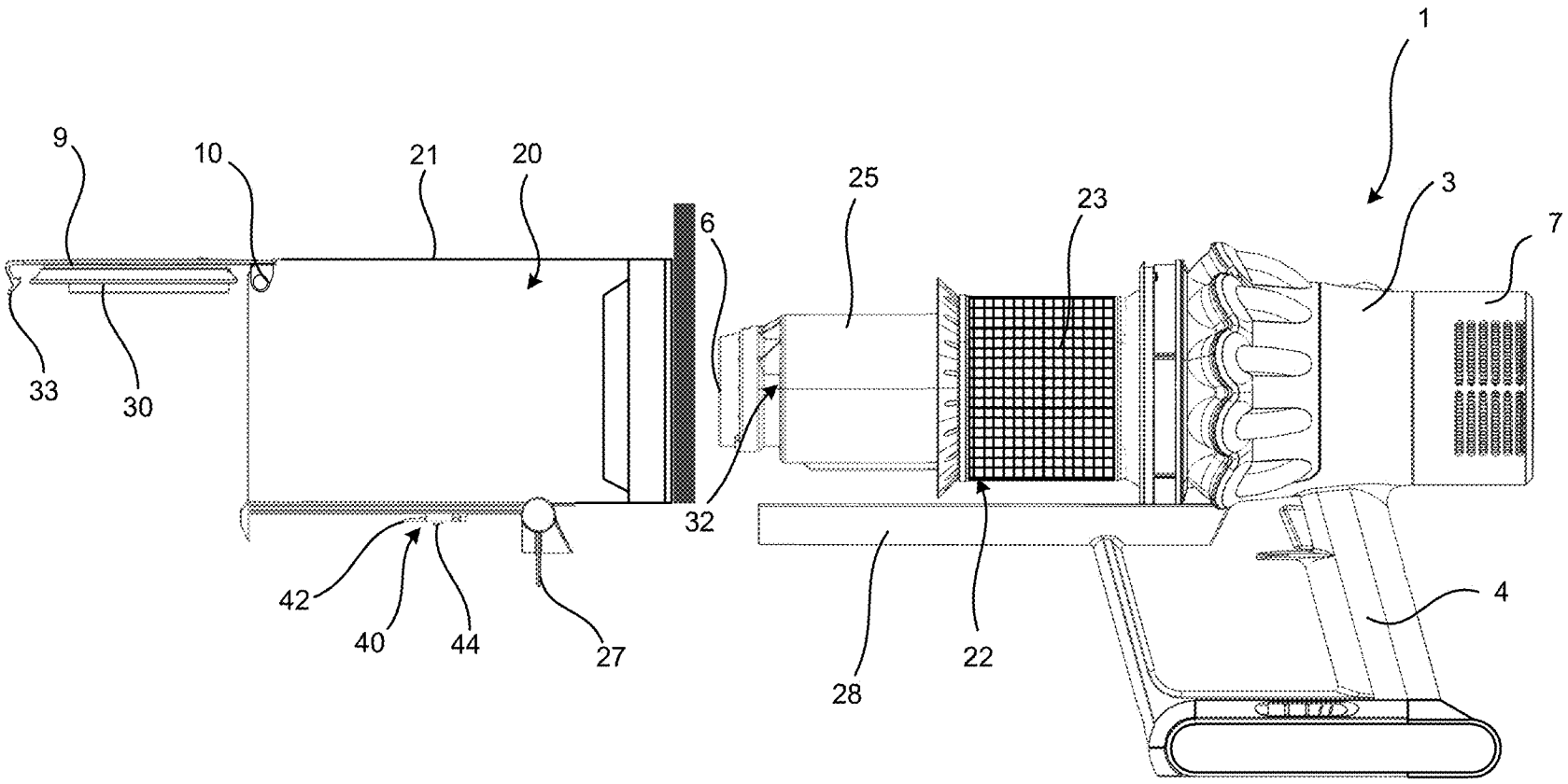
FIG. 3 shows the vacuum cleaner of FIG. 1 with the bin detached.

In order to carry out a thorough emptying or cleaning of the bin 20 it can be removed from the vacuum cleaner 1, as shown in FIG. 3. When the bin 20 is at the extended position shown in FIG. 2B, the actuating portion 42 of a release catch 40 is visible.

Figure 4A:
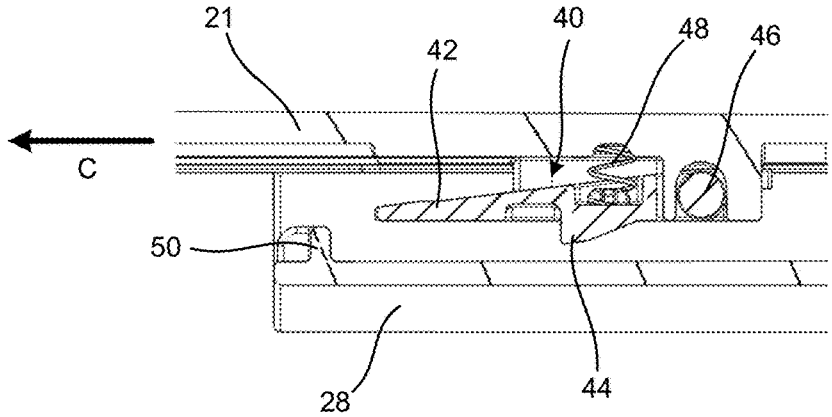
FIGS. 4A-D show a cross section through part of the vacuum cleaner of FIG. 1 in the region of a release catch at different stages during a procedure to detach the bin from the vacuum cleaner.

FIGS. 4A-D show a cross section through part of the bin 20 and runner 28 in the region of the release catch at different stages during a procedure to remove the bin 20 from the vacuum cleaner 1. The catch 40 is fixed to the outer wall 21 of the bin 20 such that it is typically hidden from view inside the runner portion as shown in FIG. 4A. The catch 40 comprises an actuating portion 42 and an engagement portion 44, and a pivot point 46. The catch 40 is biased away from the outer wall 21 by a spring 48, and can be actuated by applying a force to the actuating portion 42, which causes the spring 48 to be compressed as the catch pivots around the pivot point 46 towards the outer wall 21.

Figure 4B:
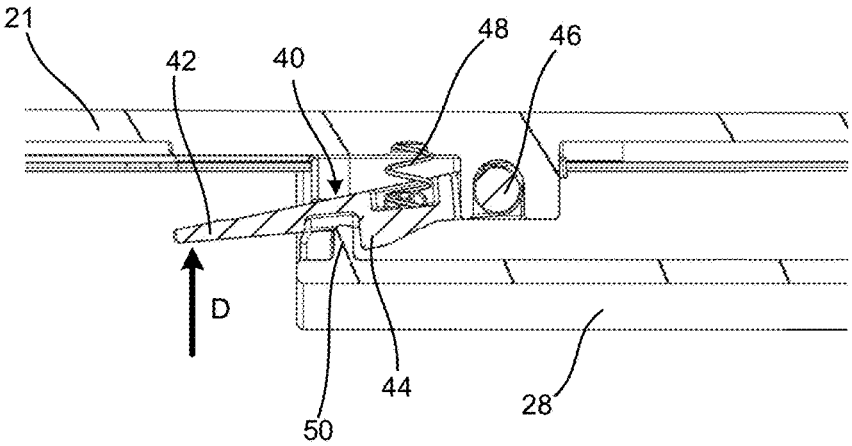

The outer wall is moved in the direction of arrow A when the bin is moved into the extended position. The outer wall stops moving when the engagement portion 44 of the catch 40 abuts against a formation 50 on the runner portion 28, and this prevents the bin from moving any further forward from the extended position as shown in FIG. 4B. FIG. 4B also shows how the actuating portion 42 of the catch 40 extends outside of the runner portion 28 when the engagement portion 44 of the catch 40 abuts against the formation 50 on the runner portion 28. It is therefore accessible to a user, and can be actuated by pressing the actuating portion 42 in towards the outer wall 21 as shown by arrow D.

Figure 4C:
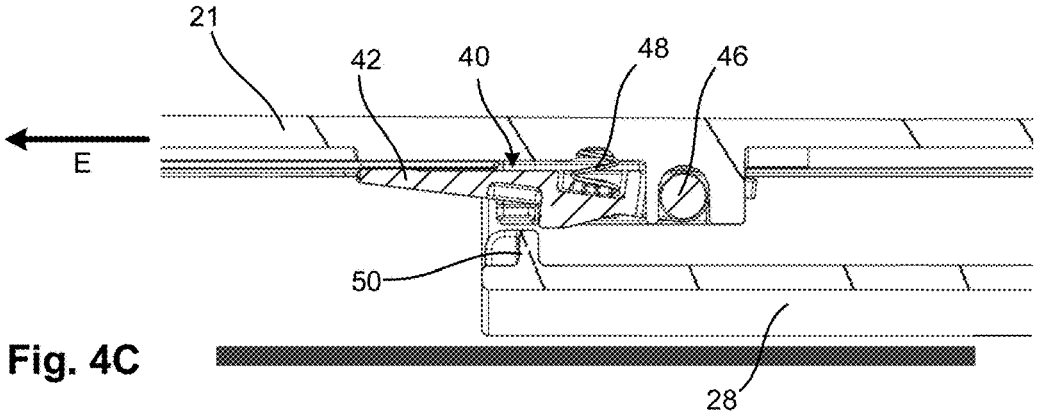
Figure 4D:
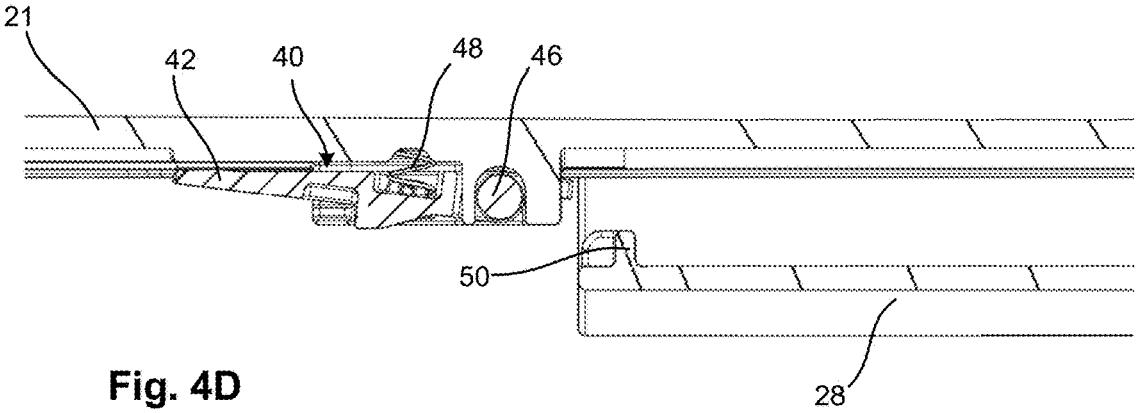

Once the catch 40 has been actuated, as shown in FIG. 4C, the engagement portion 44 of the catch 40 is disengaged from, and no longer abuts with, the formation 50 on the runner portion, and the outer wall is once again free to move forward in the direction of arrow E. Then, after being moved beyond the formation, as shown in FIG. 4D, the outer wall 21 is free to continue to slide unhindered such that the bin 20 can be slid off the runner portion 28, and detached from the vacuum cleaner 1.

Whilst particular embodiments have thus far been described, it will be understood that various modifications may be made without departing from the scope of the invention as defined by the claims.

For example, the release catch 40 has been described herein as being biased away from the outer wall 21 such that actuation of the catch 40 is by pressing the catch in towards the outer wall 21. However, an alternative release catch may be configured differently such that actuation is by pressing the actuation portion sideways.

The invention claimed is:

1. A cleaning appliance comprising:

a dirt separator for separating dirt from an airflow, the dirt separator comprising a bin for collecting dirt separated from the airflow; and a main body comprising a runner portion extending alongside a side wall of the bin, wherein the bin is slidable along the runner portion between an operational position and an extended position, a release catch releasably engages with a formation on the runner portion to prevent the bin from being separated from the cleaning appliance, and the release catch is positioned on the side wall of the bin such that it is hidden by the runner portion of the main body unless the bin is in the extended position.

2. The cleaning appliance of claim 1, wherein the release catch is pivotably fixed to the side wall of the bin.

3. The cleaning appliance of claim 1, wherein the release catch is biased away from the side wall of the bin towards the formation on the runner.

4. The cleaning appliance of claim 1, wherein the bin is removable from the cleaning appliance by first sliding the bin in a first direction from the operational position to the extended position, then disengaging the release catch from the formation, and then continuing to slide the bin in the first direction.

5. The cleaning appliance of claim 1, wherein the bin comprises a bin lid hingedly attached to the side wall of the bin, and the bin lid is pivotably movable between a closed position in which dirt is retained in the bin and an open position in which dirt can escape from in the bin.

6. The cleaning appliance of claim 5, wherein a bin lid catch releasably holds the bin lid in the closed position, and the bin lid catch is released upon the bin reaching the extended position from the operational position.

7. The cleaning appliance of claim 1, wherein the cleaning appliance is a handheld vacuum cleaner.

* * * * *